US005137390A

United States Patent [19]

Felsen

[11] Patent Number: 5,137,390

[45] Date of Patent: Aug. 11, 1992

[54] CONNECTION MEANS FOR SUSPENDED CEILING GRID

[75] Inventor: Karl H. Felsen, Winnipeg, Canada

[73] Assignee: E.H. Price Limited, Winnipeg, Canada

[21] Appl. No.: 821,624

[22] Filed: Jan. 16, 1992

[51] Int. Cl.[5] ..... B25G 3/00

[52] U.S. Cl. ..... 403/347; 403/355; 403/393; 52/667

[58] Field of Search ..... 403/346, 347, 294, 393, 403/355; 52/667

[56] References Cited

U.S. PATENT DOCUMENTS

| | | | |
|---|---|---|---|
| 3,511,012 | 5/1970 | Brady | 52/667 |
| 4,264,231 | 4/1981 | Rosenbaum | 52/667 X |
| 4,335,973 | 6/1982 | Beck et al. | 52/667 X |
| 4,548,013 | 10/1985 | Briceno | 52/667 |

FOREIGN PATENT DOCUMENTS

| | | |
|---|---|---|
| 1213118 | 10/1986 | Canada . |
| 1215514 | 12/1986 | Canada . |

*Primary Examiner*—Andrew V. Kundrat
*Attorney, Agent, or Firm*—Ridout & Maybee

[57] ABSTRACT

A connector member for connection to a T-bar is in the form of a plate with a lug extending from one side. The T-bar has an aperture which snugly receives the lug when the plate is applied on the side of a web of the T-bar. The lug extends through the aperture and defines an opening with the side of the web opposite the side on which the plate is applied. The opening faces longitudinally of the T-bar. A keeper member is slidable longitudinally from a locking position in the opening in which it resists lateral withdrawal of the lug from the aperture to an unlocking position in which the keeper member disengages the lug and allows the plate to be separated from the T-bar web.

15 Claims, 3 Drawing Sheets

10a
10b
11
13
15
16
17a
18
19
20
21
22
23
23a
24
26
27
28
29
30
31
32
33
38
39
40
40a
41
59
61

CONNECTION MEANS FOR SUSPENDED CEILING GRID

The present invention relates to connection means for a suspended ceiling grid.

Canadian Patents 1,213,118 and 1,215,514 describe connection means wherein a plate-form connector member has a lug member passing through an aperture in a planar web of a T-bar. A keeper member is engaged with the lug member to retain the connector member against separation from the web of the T-bar. The arrangement shown in the above Canadian patents requires notching of the upper edge of the T-bar to accommodate the keeper member and the step of notching the T-bars increases the complexity of and costs of manufacture and the complexity of tooling required, particularly since a number of different heights of T-bar are currently in use. In addition, the strength and security of the engagement of the keeper member with the lug member is not as great as is desirable.

The present invention provides connection means for use in a suspended ceiling grid comprising in combination a T-bar having an elongated planar web and a flange on one edge, the web having an aperture adjacent one end, a connector member comprising a plate having a planar side adapted to be applied to one side of the web and having a lug member extending from the plane of said side and adapted to project through and to fit snugly in the aperture in the web, said lug member when projecting through said aperture defining with a second side of the planar web opposite to said one side an opening facing longitudinally of said planar web, and a keeper member received in said opening in a locking position, wherein the keeper member engages in the opening between the lug member and the web and retains the lug member from withdrawal from the aperture, and sliding longitudinally of the web from said locking position to an unlocking position in which the keeper member is freed from the lug member, thereby allowing the lug member to withdraw from the aperture, said connector member having a connection portion for connection to a further suspended ceiling grid element.

This arrangement eliminates the need for notching of the T-bar ends and can provide a significant cost saving and simplification of tooling especially where the invention is applied to T-bars of various heights.

In preferred forms of the connection means, the lug member is of channel section and comprises a channel bottom extending between and integral with two side portions extending along the opposed sides, respectively, of a rectangular aperture formed in the planar web of the T-bar. Preferably also, the keeper member comprises a continuously longitudinally arcuately bowed portion and is compressed resiliently between a planar surface formed by the bottom of the channel and the side of the web opposite from the side on which the plate is applied. These arrangements provide for increased strength and accuracy of the engagement between the plate and the planar web of the T-bar.

The invention will now be more fully described, by way of example only, with reference to the accompanying drawings, in which.

Figures 1, 2:
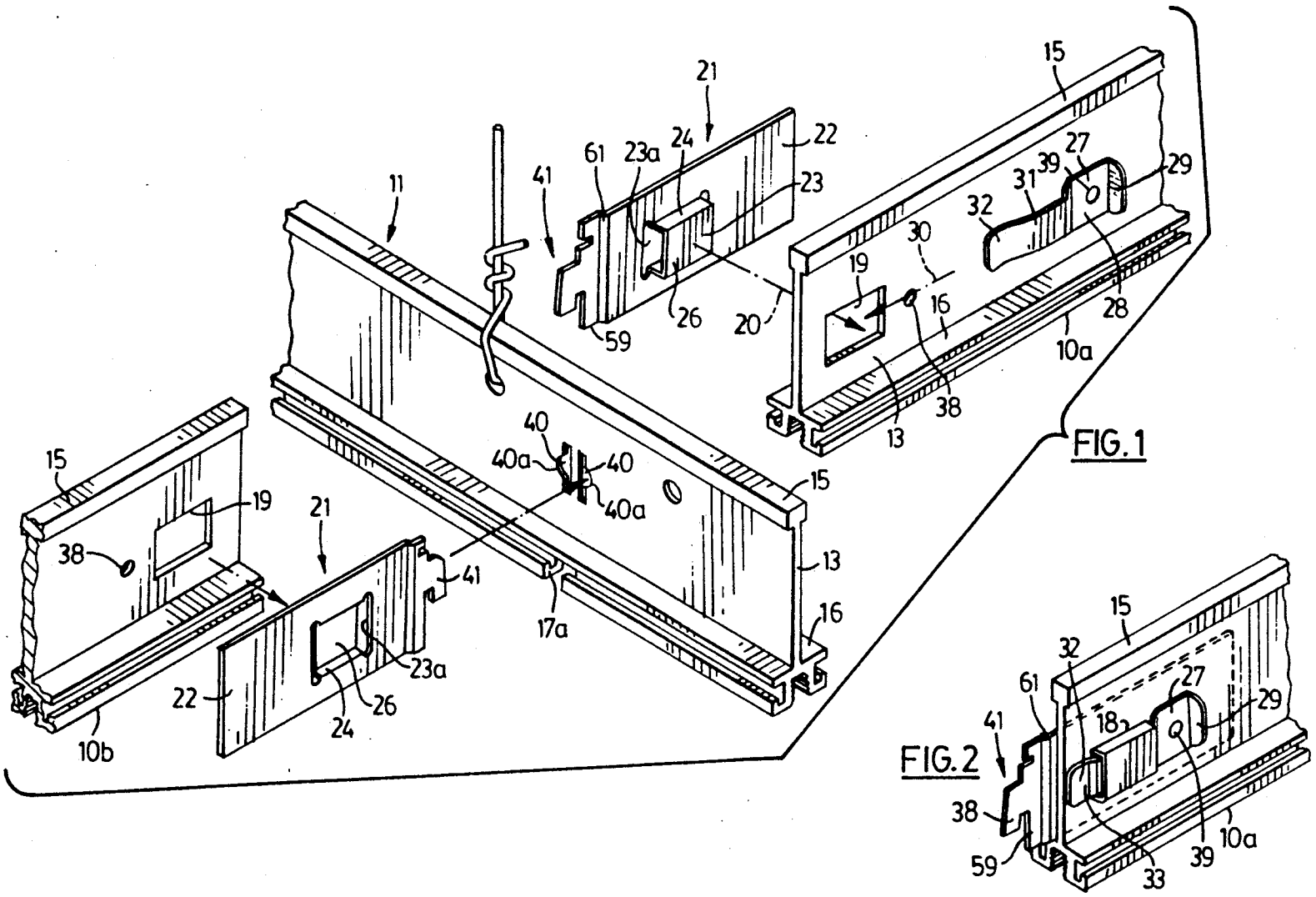
FIG. 1 is an exploded partial perspective view of a grid member and two cross bars provided with connection means in accordance with the invention.
FIG. 2 is a partial perspective view of one end of a cross bar with connection means in assembled condition.

Referring to the drawings, FIG. 1 shows first and second T-bars 10*a* and 10*b* and a grid member 11 forming part of a suspended ceiling grid. The member 11 is suspended from support structure (not shown) by a wire 12 passed through a hole in the member 11 in the conventional manner.

In the example shown, the members 10*a*, 10*b* and 11 are of similar cross section. Each may be fabricated from the same extrusion. Each member comprises a planar web 13 having a thickened upper edge 15 which imparts stiffness, and a laterally extending flange 16 at the opposite edge. In the example illustrated, the members are extruded with a downwardly opening channel 17 having, serrated channel sides for connection to vertical partition walls or the like. As seen in FIG. 1, at a point where a cross bar 10*a* or 10*b* is to be attached, the lower side of the member 11 may be notched, as at 17*a* to provide continuity for the channels 17. A lower re-entrant lip 18 extends outwardly and upwardly from each side of the channel 17 to provide a side recess to cooperate with and receive conventional elements of the ceiling structure.

In the example illustrated, it is desired to connect the cross bars 10*a* and 10*b* in longitudinal registry or alignment on opposite sides of the main member 11. Adjacent one end, each cross bar 10*a* and 10*b* is punched with a rectangular through-aperture 19 which is elongated in the longitudinal direction of the bar 10*a* or 10*b*. To connect the bars 10*a* and 10*b* to the member 11, connector members 21 are provided each comprising a rigid plate 22 from which is struck laterally outwardly a channel section lug member 23 having channel side portions 24 and a channel bottom 26 offset from and parallel to the plate 22. The lug member 23 is dimensioned so that the outer surface of the channel sides wedge snugly, without appreciable clearance, with a longer (upper and lower) sides of the aperture 19 when the lug member is inserted in the aperture 19. Further, each end of each channel side portion 24 engages, without appreciable clearance, on the adjacent shorter (vertical) side of the aperture 19. Thus, when the lug member 23 is pressed firmly into the aperture 19, in the direction of the arrow 20 in FIG. 1, the upper and lower horizontal portions 24 wedge within the aperture 19 without appreciable clearance between portions 24 and the vertical and horizontal edges of the aperture 19. When the member 23 is introduced into the aperture 19, the channel bottom defines a longitudinally-opening recess with the side of the web 13 opposite the plate 22. A thin resilient metal plate keeper member 27 is insertable longitudinally inwardly into this recess in the direction of the arrow 30 shown in FIG. 1 to the locked position shown in FIGS. 2 to 4.

As seen in the drawings, the keeper member 27 comprises a planar rectangular portion 28 having formed on one end a laterally outwardly extending finger tab 29. A narrow tongue 31 extends from the opposite end of the portion 28 and is continuously smoothly arcuately bowed so that initially it arcs smoothly outwardly from the plane of the portion 28, and then smoothly inwardly toward the said plane. The tongue 31 terminates in a rounded tip 32 inclining laterally outwardly away from a vertical transition 33 in the plane of the portion 28. In order to insert the keeper member 27 in the opening between the lug member 23 and the web 13, the finger tab 29 is grasped in the fingers with the keeper member 27 inclined inwardly toward the web 13. The tab 29 is then pushed longitudinally to drive the tongue 31, in the direction of the arrow 30 in FIG. 1, through one end of the opening. The outwardly inclined tip 32 assists in guiding the keeper member out through the opposite end of the opening, to the position shown in FIGS. 2 to 4 and avoids the tendency for tip 32 to become misdirected into the aperture 19 or into the aperture 23*a* left in the plate 22 by the operation of striking the lug member from the plate 22.

Figure 3:
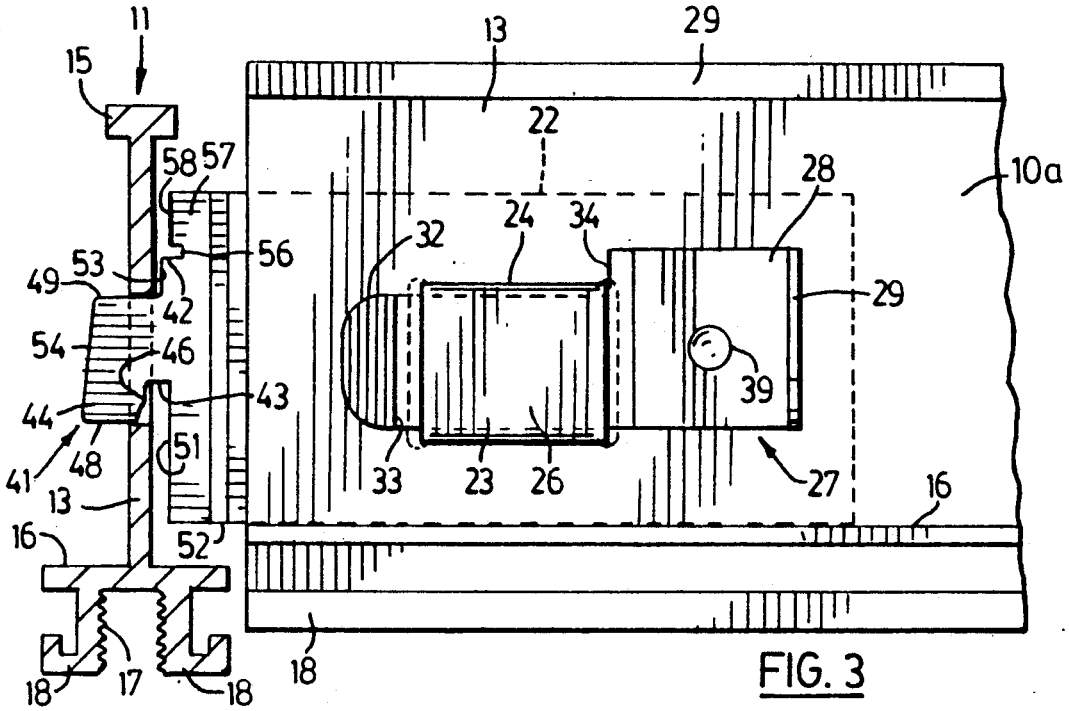
FIG. 3 shows a side view, partially in section, of the connection means applied to the cross bar, in the course of introducing the connector portion through a slot in the main grid member.
Figure 4:
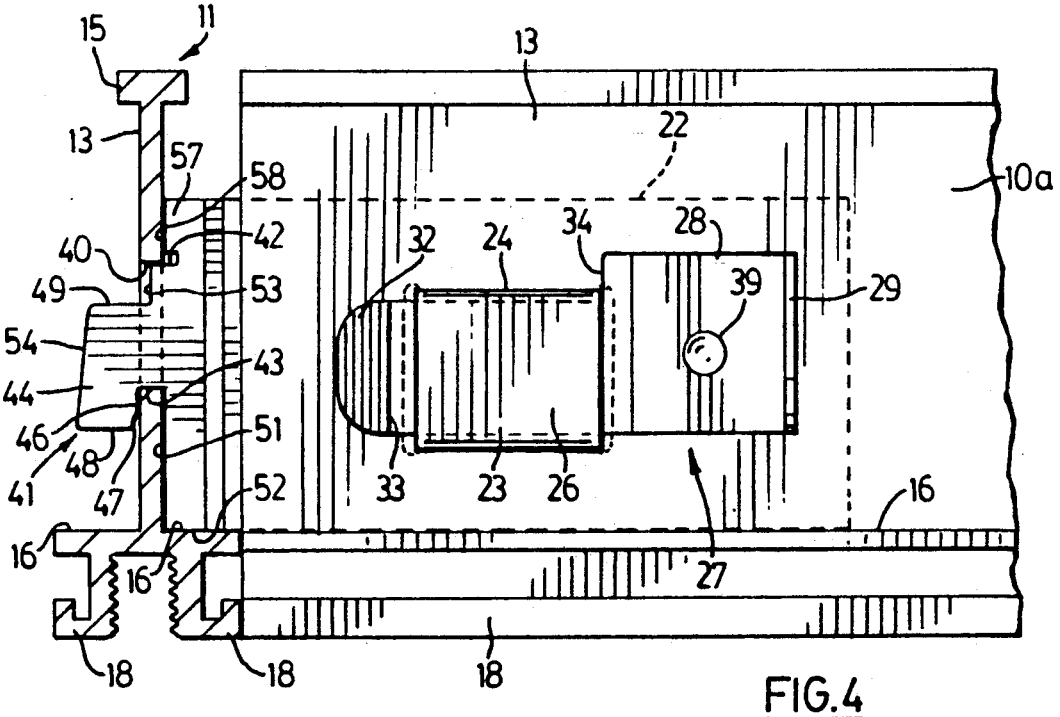
FIG. 4 shows a view corresponding to FIG. 3, with the connection portion fully secured to the main grid member.

The transition between the wide rectangular portion 28 and the narrow tongue 31 forms a stop edge 34 extending transversely. The stop edge 34 limits insertion of the keeper member 27 by engaging a transversely (vertically) extending edge of the adjacent channel side portion 24, as seen in FIGS. 3 and 4. The lateral deviation of the bowed portion of the tongue 31 from the planar portion 28 in the uncompressed or relaxed condition is greater than the lateral space between the side of the planar web 13 opposite the plate 22 and the inner side of the channel bottom 26 when the plate member 22 is applied to the web 13 as seen in FIGS. 2 to 4. In the fully inserted locking position, seen in FIGS. 2 to 4, wherein the stop edge 34 engages the end of the channel side 24, the central, maximally outwardly bowed portion of the tongue 31 is disposed in engagement with approximately the transverse (vertical) median 36 of the channel 24 and the transition 33 engages the planar web longitudinally outwardly from the adjacent side of the aperture 29 in the web 13, so that the bowed portion of the tongue 31 is resiliently compressed between the channel bottom 24 and the web 13 and the resilient reaction causes the keeper member to engage positively frictionally on the channel bottom 24 and the web 13 and to urge the lug member 23 in the direction tending to insert the lug member 23 more firmly into the aperture 19. In the locking position, therefore, as seen in FIGS. 2 to 4, the plate 22 is retained against movement laterally away from, and against movement longitudinally or transversely with respect to, the web 13.

In order to maintain the keeper member 27 positively in the locking position, the web 13 is formed with a recess or hole 38 adjacent the aperture 19 and the planar portion 28 of the keeper member 27 has a projection or dimple 39 extending laterally outwardly in the direction opposite to the bowed tongue 31. When the keeper member is passed into the opening in the direction of the arrow 30, the projection 39 snaps into the recess 38 in the locking position, thus further resisting withdrawal of the keeper member. As will be appreciated, when it is desired to remove the plate 22, the keeper member 27 may be disengaged with a forceful push outwardly on the finger tab 29 in the direction opposite to the arrow 30 in order to slide the keeper member longitudinally to the unlocking position as shown in FIG. 1, allowing the lug member 23 to be disengaged from the aperture 19.

In the example shown in FIGS. 1 to 4, the main grid member 11 is fabricated with a pair of generally rectangular vertically extending slots 40 at the point at which it is desired to connect the cross T-bars 10*a* and 10*b* from opposite sides. As seen in FIG. 1, usually the slots 40 are punched in the web 13 and, to reinforce the punches, they may have a reinforcing protrusion on one side, so that the slots 40 are formed with corresponding outwardly recessed arcuate portion 40*a*.

On one end, the plate 22 carries a forwardly projecting connector portion 41 comprising an integral tab struck from the material of the plate 22. The tab has a longitudinally or horizontally extending upper edge 42 and a notch in its lower surface providing a horizontally extending lower edge 43 defining with the edge 42 a neck of width about the same as that of each slot 40 formed in the web 13 of the main member 11. Forwardly of the lower edge 43, the inner lower side of the head portion 41 provides a transversely extending edge 46 extending generally perpendicular to the edge 43 and extending downwardly to a downwardly and forwardly inclining edge 47 terminating at a longitudinally extending lower edge 48. The width of the head portion 44, defined between the lower edge 48 and an upper edge 49, defining a stepped upper surface of the head portion 44, is approximately the same width as that of the neck defined between the edges 42 and 43 i.e. approximately the same as the width of each slot 40. At the inner end of the edge 43, the connector member has a transversely extending planar end face 51 equal in width to the thickness of the plate 22 and spaced from the transverse edge 46 a distance about equal to the thickness of the web 13. As seen in FIGS. 3 and 4, the lug member 23 is arranged on the plate 22 so that when the lug member 23 engages the aperture 19, a lower edge 52 of the plate 22 engages the upper side of the flange 16 of the T-bar 10*a* or 10*b* on the side to which the plate 22 is applied. The end face 51 extends down to the lower edge 52 in the preferred form. A transversely or vertically extending edge 53 extends between the upper edges 42 and 49, slightly rearwardly of the transverse edge 46. The leading edge 54 of the head portion 44 inclines downwardly and forwardly.

Above the upper edge 42 and separated therefrom by a small rearwardly extending recess 56 the connector member 21 has an upper end portion 57 having a planar end face 58 in alignment with the planar end face 51.

As seen in FIGS. 1 and 2, an end portion 59 of the connector member 21 carrying the neck portion, head portion 44, the end face 51 and the portion 57, is offset laterally outwardly from the main portion of the plate 22 in the direction opposite to the lug member 23, and is connected to the main portion by a outwardly inclining transition 61, so that when the plate 22 is applied to the web 13 of the cross bar 10*a* or 10*b* the laterally inner face of the end portion 59 is offset outwardly a small distance from the adjacent face of the web 13. The spacing between the slots 40 is approximately equal to twice this distance plus the thickness of the web 13, so that when cross bars 10*a* and 10*b* having connector members 21 applied thereto, as seen in exploded form in FIG. 1, are engaged from opposite sides of the main member 11 and the head portion 44 of each connector member 21 is engaged in a respective slot 40, the two cross bars 10*a* and 10*b* are in longitudinal alignment.

In use, the arrangement shown in FIGS. 1 to 4 may be employed to advantage in the installation of a suspended ceiling grid. The grid lay-out may be the conventional basket weave arrangement, in which case each of the members, such as the members 10*a*, 10*b* and 11, is of the same length, each has a pair of slots 40 at its mid point, and each has a connector member 21 pre-applied to each end. In setting out the basket weave grid, one end of each member similar to member 10*a* is connected to a mid point of another member, similar to member 10*a* and having a pair of slots 40 formed in its web at its mid point. Alternatively, the lay-out may comprise a plurality of relatively long or continuous main members 11 disposed parallel to one another at regular transverse spacings, and with pairs of slots 40 formed therethrough at regular intervals, appropriate for the desired grid lay-out. A plurality of cross bar members such as the members 10*a* and may then be employed, which may be of standard lengths matching the transverse spacing between the flanges 16 of the main members 11, and which will each have at each end a connector member 21 secured thereto. In making a connection between a cross bar 10*a* or 10*b* and a slot 40 in a bar 11 or the like at right angles thereto, the cross bar 10*a* or 10*b* is brought down from above, while maintaining the cross bar in a horizontal attitude, with the web 13 held vertical, until the leading edge or tip of the head portion 44 of the connector portion 41 engages the web 13 of the adjacent member 11 above a slot 40: In the case in which a cross bar 10*a* is applied between two parallel members 11, the installer may press laterally inwardly on the outer side of the member 11 as the cross bar 10*a* or 10*b* is pushed downwardly, so that, at the point where the tip of the or each head portion 44 enters a slot 40, the upper edge of the slot 40 reacts with the inclining edge 54 to urge the cross bar 10*a* or 10*b* downwardly until the position as shown in FIG. 3 is momentarily reached, at which the head portion 44 enters the slot 40. Further compressive force applied to the member 11 results in the inner side of the planar web 13 moving inwardly relative to the head portion 44 until it reaches the vertical edge 53. At this point, a lower margin of the inclining lower edge 47 has slid over the lower edge of the slot 40, this margin being spaced forwardly from the vertical surface 53 by a distance slightly greater than the thickness of the web 13. Hand pressure exerted downwardly on the cross bar 10*a* or 10*b* now causes the inclining edge 47 to ride over the lower edge of the slot 40, tending to resiliently bias the metal of the head portion 44 forwardly and slightly upwardly against the reaction of the surface of the vertical edge 53 with the planar web 13 in the region above the slot 40. The notch defined between the edges 43, 46 and 51 now snaps over the lower edge of the slot 40, and at the same time the upper edge 42 of the neck portion snaps into the slot 40, as shown in FIG. 4, relieving the tensile stress in the head portion 44. In this position, the cross bar 10*a* or 10*b* is securely retained in engagement with the member 11. The engagement of the upper edge 42 of the neck portion on the upper edge of the slot 40 and of the transverse edge 43 on the lower edge of the slot 40 resists any tendency for the connector member to become disengaged from the slot 40 through any disturbance of the cross bar 10*a* or 10*b* or of the member 11 tending to result in an upward tilting motion of the bar 10*a* or 10*b* relative to the member 11.

The end face 58 of the upper end portion 57 engages the side of the web 13 in the engaged position shown in FIG. 4, and supports the member 13 and the cross bar 10 against such tilting motion relative one another. Further, downward tilting motion of the cross bar 10*a* or 10*b* relative to the member 13 is resisted by the end face 51 engaging the web 13, the lower edge 52 engaging the upper side of the flange 16 of the member 11 and the end face of the flange 16 and lip 18 of the cross bar 10*a* or 10*b* engaging the side surfaces of the flange 16 and lip 18 on the member 13. Hence the engagement of the bar 10*a* or 10*b* with the member 13 is secure.

Preferably, the connector member 21 is arranged so that in the installed position shown in FIG. 4, its lower edge 52 rests on the flange 16 of the member 13, so that the weight of the bar 10*a* or 10*b* is transmitted to the member 13 through the engagement of this surface 52 on the flange 16, rather than through the engagement of the connector portion 41 on the lower edge of the slot 40.

With the arrangement as shown in the drawings, a bar 10*a* or 10*b* locked in position between a member 11 through a locking connection as illustrated in FIG. 4, may readily be disconnected by withdrawing the keeper member 27 to permit the connector member 21 to be detached from the end of the cross bar, without needing to disturb or deflect the adjacent member e.g. the member 11 with which the connector member 21 is engaged. After removal of the bar 10*a* or 10*b*, the connector member 21 can be levered out of the slot 40 applying normal hand pressure to tilt the plate 21 downwardly relative to the member 11. It will be appreciated that this greatly facilitates removal of bars 10*a* or 10*b* where, for any reason, it is desired to remove a bar from a selected location in the grid arrangement without destroying the grid arrangement.

Figure 5:
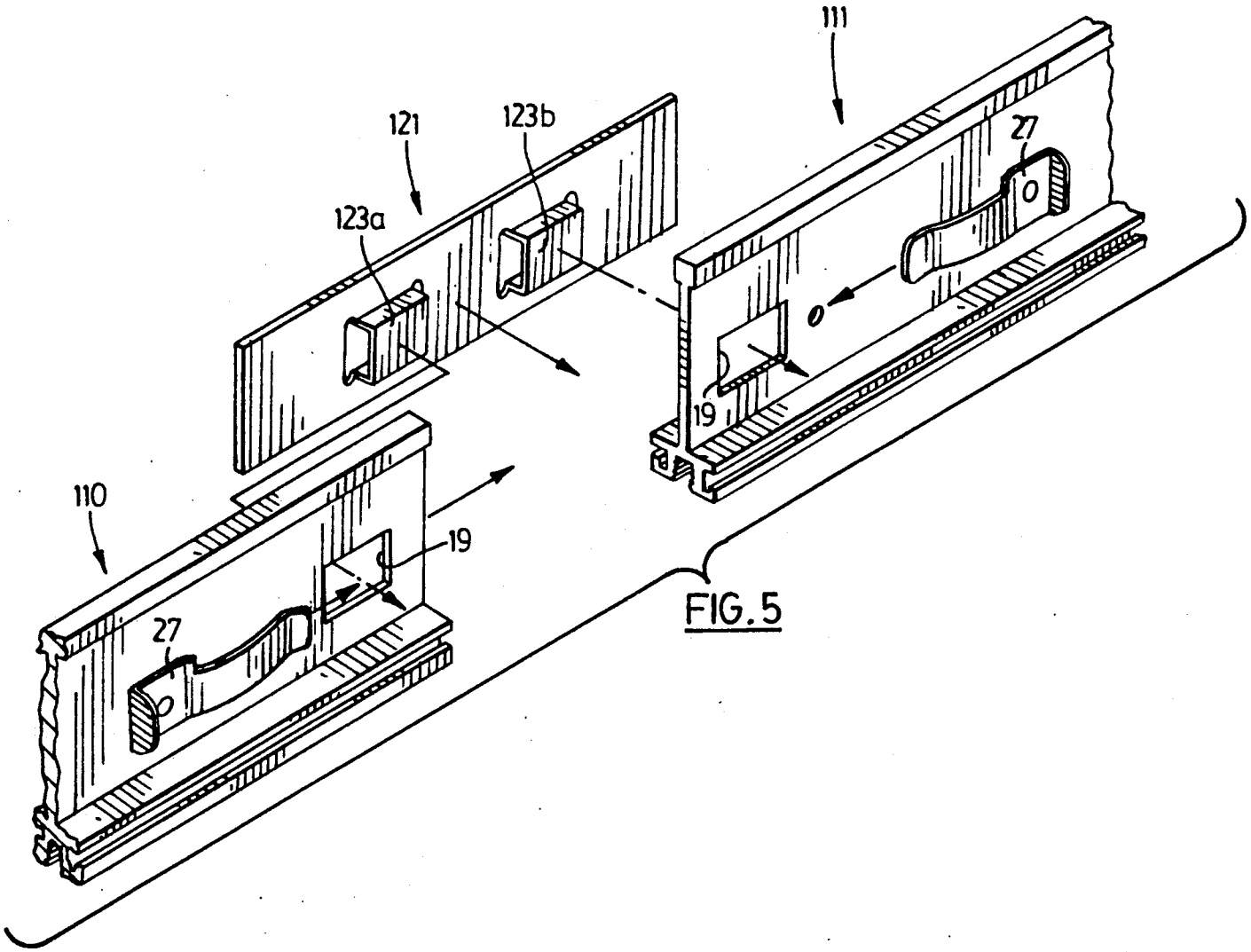
FIG. 5 is a partial perspective view showing a modified form of connector means used for splicing two T-bars together.

The locking arrangement employing the aperture 19, lug member 23 and the keeper member 27 can advantageously be employed for splicing together the juxtaposed ends of T-section bars or like members which provide an elongated planar web portion. In such case, as illustrated in FIG. 5 each member 110 and 111 to be joined is formed with a through-aperture 19 adjacent each end. A splice plate 121 is employed comprising a planar, rectangular plate having two lug members 123*a* and 123*b* struck therefrom similar to the lug member 23 at a longitudinal spacing corresponding to the desired spacing between the through apertures 19 formed in the longitudinal members 110 and 111 when their ends are juxtaposed. As will be readily appreciated, by employing this splice plate 121, the juxtaposed ends of the longitudinal members to be spliced can be locked together by inserting a resilient keeper member, such as the keeper members 27 through each lug members 123*a* and 123*b*. This splicing plate may be particularly useful for joining together the ends of relatively long sections of T-bar members to form relatively long, structurally continuous main grid lengths in a ceiling grid, between which cross bars similar to the cross bars 10*a* and 10*b* are to be supported.

In the preferred form, the cross bars 10*a*, 10*b* and members 11, 110 and 111 are provided in standardized lengths and, as manufactured, are pre-punched with the through-apertures 19 adjacent each end and with pairs of the slots 40 at standard intervals and are furnished to the ceiling structure installers as units with the connector members 21 pre-applied and pre-locked in place on each end, thus avoiding the need for the ceiling installer to install the connector members separately and avoiding the use of separate clip elements which may become misplaced or lost.

It may be mentioned that a further advantage of the arrangement shown in the drawings is that the parts of the connector member i.e. the plate 21 including the connector portion 41 and the keeper member 27 may be removed from an installation without needing to permanently distort them. The connector members therefore are re-useable.

While in the accompanying drawings the connection between T-section members has been illustrated, it will be appreciated that the use of the above-described connector members is not thus limited. As will be appreciated, the connector member 21 as illustrated is attachable to other members having a web through which an aperture similar to the aperture 19 may be punched, and the connector portion 41 may likewise be employed to connect to other webs of suitable thickness defining a slot opening similar to the slot 40 e.g. to a wall of a channel-shaped member or other member providing a side wall. It will also be appreciated that, less advantageously, the connector member 21 may be formed with connector portions of known configuration different from the connector portion 41 illustrated, for connection to various forms of grid members. Likewise, although with considerably less advantage, the connection portion 41 and associated surfaces as seen in profile in FIG. 3 may be fabricated on the end of a bar such as the T-bar 10*a* by cutting, stamping or milling the end of the bar to provide it integrally with a connection portion 41 rather than with a removable connection portion as provided by the detachable member 21.

The bars and members 10*a*, 10*b*, 11, 110, 111, 21, 27 and 121 will usually be fabricated of metal or plastics. Usually, the connector members 21 and 121 and the keeper members 27 will be formed of metal having sufficient strength and, in the case of the keeper member 27, sufficient resiliency e.g. of steel. It will be appreciated, however, that other materials having comparable physical properties, e.g. high strength plastics, may be employed. In the case in which the connector member 21 or 121 is formed by stamping and striking from metal plate in a series of progressive dies, preferably the channel section lug member 23, 123*a* or 123*b* is formed to its final dimensions by restriking at the end of the tooling cycle to control its shape and dimensions within required tolerances.

We claim:

1. Connection means for use in a suspended ceiling grid comprising in combination a T-bar having an elongated planar web and a flange on one edge, the web having an aperture adjacent one end, a connector member comprising a plate having a planar side adapted to be applied to one side of the web and having a lug member extending from the plane of said side and adapted to project through and to fit snugly in the aperture in the web, said lug member when projecting through said aperture defining with a second side of the planar web opposite to said one side an opening facing longitudinally of said planar web, and a keeper member received in said opening in a locking position, wherein the keeper member engages in the opening between the lug member and the web and retains the lug member from withdrawal from the aperture, and said keeper member sliding longitudinally of the web from said locking position to an unlocking position in which the keeper member is freed from the lug member, thereby allowing the lug member to withdraw from the aperture, said connector member having a connection portion for connection to a further suspended ceiling grid element.

2. Connection means as claimed in claim 1 wherein said aperture is rectangular having a first pair of opposed sides parallel to the edges of the web and said lug member comprises two portions extending along the opposed sides, respectively, of the rectangular aperture and each having end edges respectively engaging a second pair of opposed sides of the rectangular aperture in the locking position.

3. Connection means as claimed in claim 2 wherein said lug member is of channel section and comprises a channel bottom extending between and integral with said portions.

4. Connection means as claimed in claim 1 wherein said lug member has a planar surface facing toward, offset from and substantially parallel to the planar side of the connector member, said planar surface defining one side of said opening, and said keeper engaging between the planar surface and said second side of the web in the locking position.

5. Connection means as claimed in claim 4 wherein the keeper member is compressed resiliently between said planar surface and said second side of the web in the locking position.

6. Connection means is claimed in claim 5 wherein the keeper member comprises a continuously longitudinally arcuately bowed portion which is compressed in said locking position.

7. Connection means as claimed in claim 5 wherein said keeper member comprises at one end a planar portion engaging said second side of the web in the locking position.

8. Connection means as claimed in claim 7 wherein an end of the keeper member opposite said one end comprises a tip inclining laterally outwardly away from the plane of said planar portion in the locking position.

9. Connection means as claimed in claim 7 wherein the keeper member comprises a stop edge extending transversely on an inner edge of said planar portion and engaging an edge of said lug member in the locking position.

10. Connection means as claimed in claim 9 wherein the keeper member comprises a laterally outwardly extending finger tab on an edge of the planar portion opposite said stop edge.

11. Connection means as claimed in claim 7 wherein the second side of the web is formed with a recess adjacent the aperture, and the planar portion of the keeper member is formed with a projection snapping into said recess to locate the keeper member relative to the web in the locking position.

12. Connection means as claimed in claim 1 wherein said connection portion comprises a planar hook-shaped member generally parallel to and offset from said plate in the direction opposite to the direction in which the lug member projects.

13. Connection means as claimed in claim 12 further comprising a main grid member having formed therethrough a first slot for receiving the hook-shaped member of the connector member of said first-mentioned T-bar and a second slot adjacent the first slot for receiving a hook-shaped member of a connector member of a second T-bar similar to the first-mentioned T-bar, and applied from a side of said grid member opposite from the side on which said first-mentioned T-bar is applied, said slots being spaced laterally by such distance that the first-mentioned and second T-bars are in longitudinal alignment.

14. Connection means as claimed in claim 1 for use in splicing two T-bars together wherein said connection portion comprises a second lug member on said plate extending parallel to the first-mentioned lug member, and a second keeper member, whereby the second lug member can be passed through an aperture formed in a second T-bar juxtaposed to the first-mentioned T-bar and can be locked thereto.

15. Connection means for use in a suspended ceiling grid comprising in combination a T-bar having an elongated planar web, a flange on one edge, and a connector portion provided on one end and extending longitudinally therefrom, the connector portion comprising a neck portion for lodging in a secured position in an opening in a side wall of a main grid member to which the T-bar is to be connected, and a head portion having a lower edge inclining forwardly and downwardly from a lower edge of the neck portion, wherein the transverse width dimensions of the neck portion is at least as great as the transverse width dimension of the head portion, and said connector portion having a planar end face extending transversely from a longitudinally inner end of the lower edge of the neck portion to an upper side of said flange.

* * * * *